US007843141B1

(12) United States Patent
Xiong et al.

(10) Patent No.: US 7,843,141 B1
(45) Date of Patent: Nov. 30, 2010

(54) LOW COST STEP DIMMING INTERFACE FOR AN ELECTRONIC BALLAST

(75) Inventors: Wei Xiong, Madison, AL (US); Thomas Lunn, Hazel Green, AL (US); Christopher Radzinski, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 453 days.

(21) Appl. No.: 12/017,750

(22) Filed: Jan. 22, 2008

Related U.S. Application Data

(60) Provisional application No. 60/988,926, filed on Nov. 19, 2007.

(51) Int. Cl.
*H05B 37/00* (2006.01)

(52) U.S. Cl. ..... 315/224; 315/307; 315/DIG. 4

(58) Field of Classification Search ..... 315/DIG. 4, 315/224, 219, 307, 308, DIG. 5, DIG. 7
See application file for complete search history.

(56) References Cited

U.S. PATENT DOCUMENTS 4,060,751 A 11/1977 Anderson
4,585,974 A 4/1986 Stupp et al.
4,873,471 A 10/1989 Dean et al.
5,475,284 A 12/1995 Lester et al.
5,977,725 A 11/1999 Miyazaki et al.
6,741,043 B2 5/2004 Prasad
6,784,622 B2 * 8/2004 Newman et al. ..... 315/219
6,963,178 B1 * 11/2005 Lev et al. ..... 315/307

* cited by examiner

*Primary Examiner*—David Hung Vu
(74) *Attorney, Agent, or Firm*—Waddey & Patterson, PC; Mark J. Patterson

(57) ABSTRACT

A step dimming interface is utilized to operate a load such as a gas discharge lamp. The dimming interface has first and second switches for determining when the gas discharge lamp operates at either a normal power level or a dimming power level. A rectifier circuit is connected to a control signal production circuit. By manipulating the first and second switches, the rectifier sends either a full-wave rectified signal or a half-wave rectified signal to the control signal production circuit which determines the output of the control signal production circuit. The control signal production circuit may be connected to an electronic ballast which varies the power level of the lamp according to this output.

20 Claims, 5 Drawing Sheets

LOW COST STEP DIMMING INTERFACE FOR AN ELECTRONIC BALLAST

CROSS-REFERENCES TO RELATED APPLICATIONS

This application is a non-provisional utility application which claims benefit of U.S. Patent Application Ser. No. 60/988,926 filed Nov. 19, 2007, entitled "A CONSTANT CURRENT SOURCE MIRROR TANK DIMMABLE BALLAST FOR HIGH IMPEDANCE LAMP" which is hereby incorporated by reference.

BACKGROUND OF THE INVENTION

The present invention relates generally to electronic ballasts for powering a gas discharge lamp. More particularly, this invention pertains to methods and circuits for an electronic ballast to provide step dimming of a gas discharge lamp.

Public, commercial, and industrial entities often require the use of multiple lighting fixtures to adequately illuminate a facility or an outdoor space. To reduce the power consumed to light these facilities and outdoor spaces, gas discharge lamps are often utilized because of relatively low power consumption when compared to incandescent lamps. Although energy consumption is reduced by the use of these gas discharge lamps, these entities can further reduce energy consumption through the use of two-level or high-low step dimming interfaces to control the inverters in the ballast systems that power the gas discharge lamps. These systems can be used to switch lighting fixtures from a low-wattage energy saving operation (dimming) to a normal wattage operation thus providing significant cost savings.

Unfortunately, prior art step dimming interfaces often require expensive components such as transformers and transistor switches. The initial cost of purchase of ballasts that use prior art step dimming interfaces has resulted in the under-utilization of this important energy efficient technology.

What is needed, then, is a step dimming interface for an electronic ballast that utilizes less expensive components.

BRIEF SUMMARY OF THE INVENTION

In accordance with one aspect of the invention, a dimming interface is utilized to produce a DC control signal that controls a ballast inverter circuit that powers a gas discharge lamp. This DC control signal causes the inverter circuit to vary the power output to the gas discharge lamp depending on whether the DC control signal is at a first or second level. When the DC control signal is at one level, the inverter circuit produces an AC power signal that powers the gas-discharge lamp at a dimming level. Conversely, the inverter may receive the DC control signal at a second level and produce an AC power signal to power the lamp at a normal power level.

The dimming interface of the invention has first and second input terminals for connecting to an AC power source, and a rectifier circuit coupled to the input terminals to rectify a periodic AC signal. The rectified power signal may be converted into a DC power signal that powers the ballast inverter circuit.

To control the power level of the lamp, dimming switches are preferably connected between the input terminals and the rectifier circuit. The dimming switches are the components utilized to determine if the lamp operates in a dimming mode or at normal-power. To produce a DC control signal, a dimming control signal generator circuit receives a dimming interface signal from the rectifier circuit. The dimming control signal generator circuit is responsive to the dimming interface signal to generate a DC control signal for the ballast inverter circuit. The rectifier circuit is arranged with respect to the dimming switches so that the manipulation of the first and second switches causes the dimming interface signal to be a half-wave rectified signal when each of the dimming switches are closed and a full wave-rectified signal when one of the dimming switches is open and the other dimming switch is closed.

When the dimming interface signal is a half-wave rectified signal, the DC control signal may be produced by the generator circuit at the first level which allows the lamp to operate at normal power. The DC control signal may be produced at the second level when the generator circuit receives the full-wave rectified signal. In this case, the lamp operates at a dimming level. Thus, the manipulation of the switches causes the gas discharge lamp to switch from the dimming mode to the normal mode.

In accordance with another aspect of the invention, the dimming control signal generator circuit may include a pulse generating circuit and a reference signal production circuit. Upon receiving an input signal associated with the dimming interface signal, the pulse generating circuit is responsive to generate a series of pulses. The frequency of these pulses preferably depends on whether the dimming interface signal is a full-wave or a half-wave rectified signal. In a preferred embodiment, the pulse generating circuit responds by producing the pulses at a first frequency when the dimming interface signal is a half-wave rectified signal and at a second frequency when the dimming interface signal is a full wave rectified signal.

The pulses are transmitted to a reference signal production circuit operably coupled to the pulse generating circuit. The reference signal production circuit translates the pulses into the DC control signal. The DC control signal is coupled to the inverter circuit in the ballast to determine a power output level to the gas discharge lamp.

The circuit of the present invention permits the use of inexpensive low-speed glass diodes and resistors instead of transformers and transistors, thereby reducing the cost of the step dimming interface.

BRIEF DESCRIPTION OF THE SEVERAL VIEWS OF THE DRAWINGS

FIG. 2(*b*) is a graphic representation of voltage signals produced by the embodiment of the step dimming interface shown in FIG. 1 when the second dimming switch is open and the first dimming switch is closed.

DETAILED DESCRIPTION OF THE INVENTION

Figure 1:
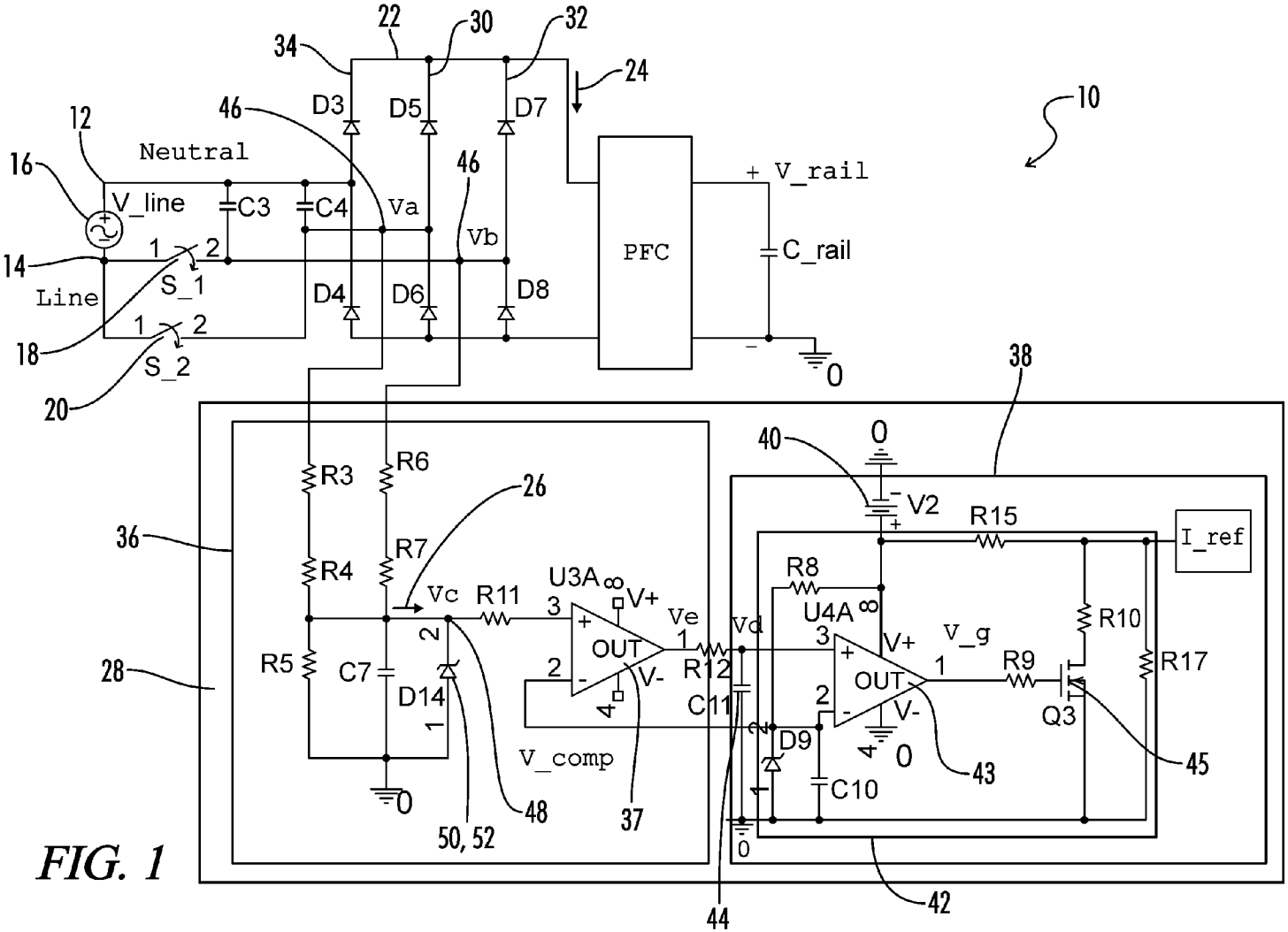
FIG. 1 is a schematic of an embodiment of the step dimming interface of the present invention.
Figure 2A:
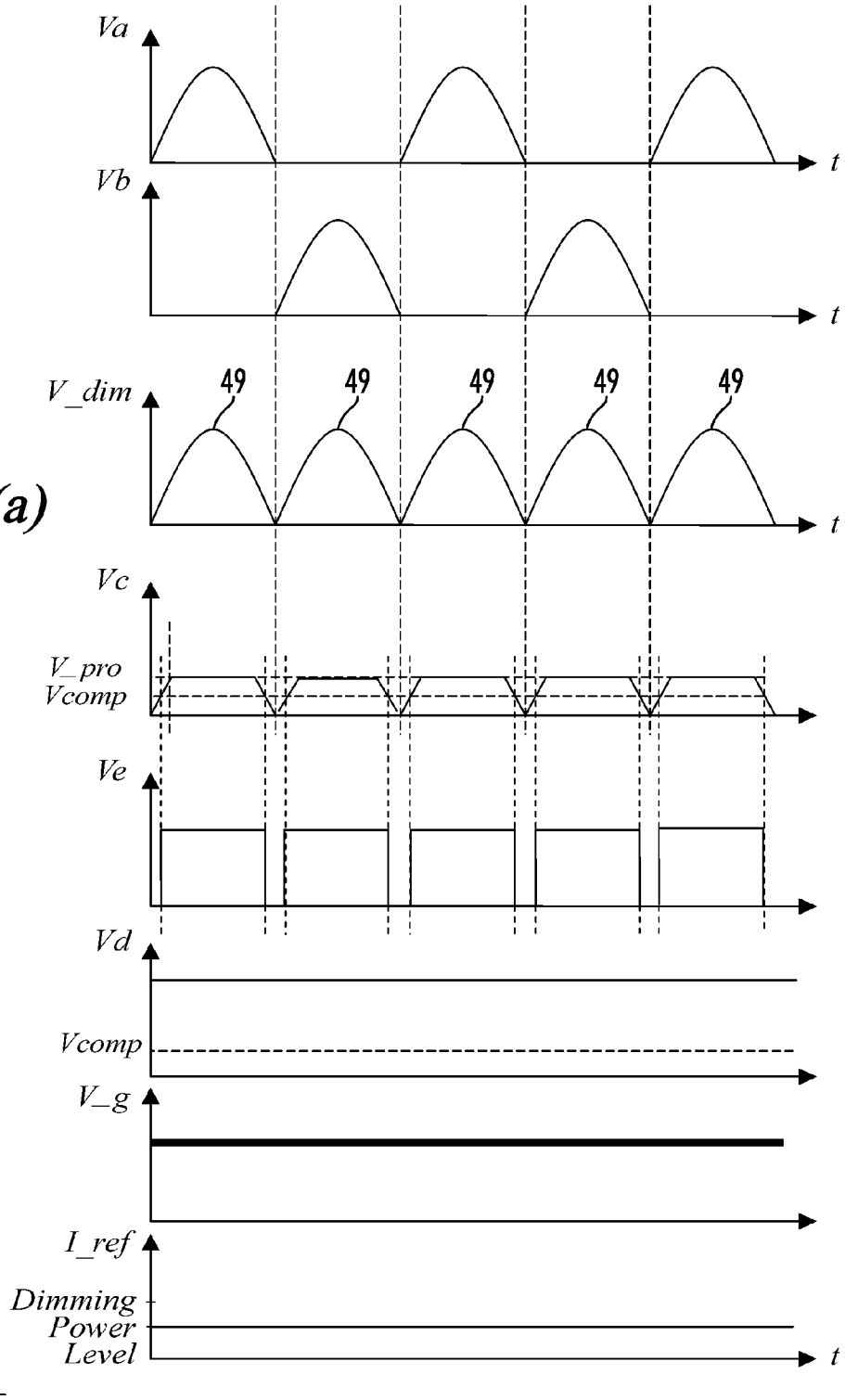
FIG. 2(*a*) is a graphic representation of voltage signals produced by the embodiment of the step dimming interface shown in FIG. 1 when the first dimming switch is open and the second dimming switch is closed.
Figure 2B:
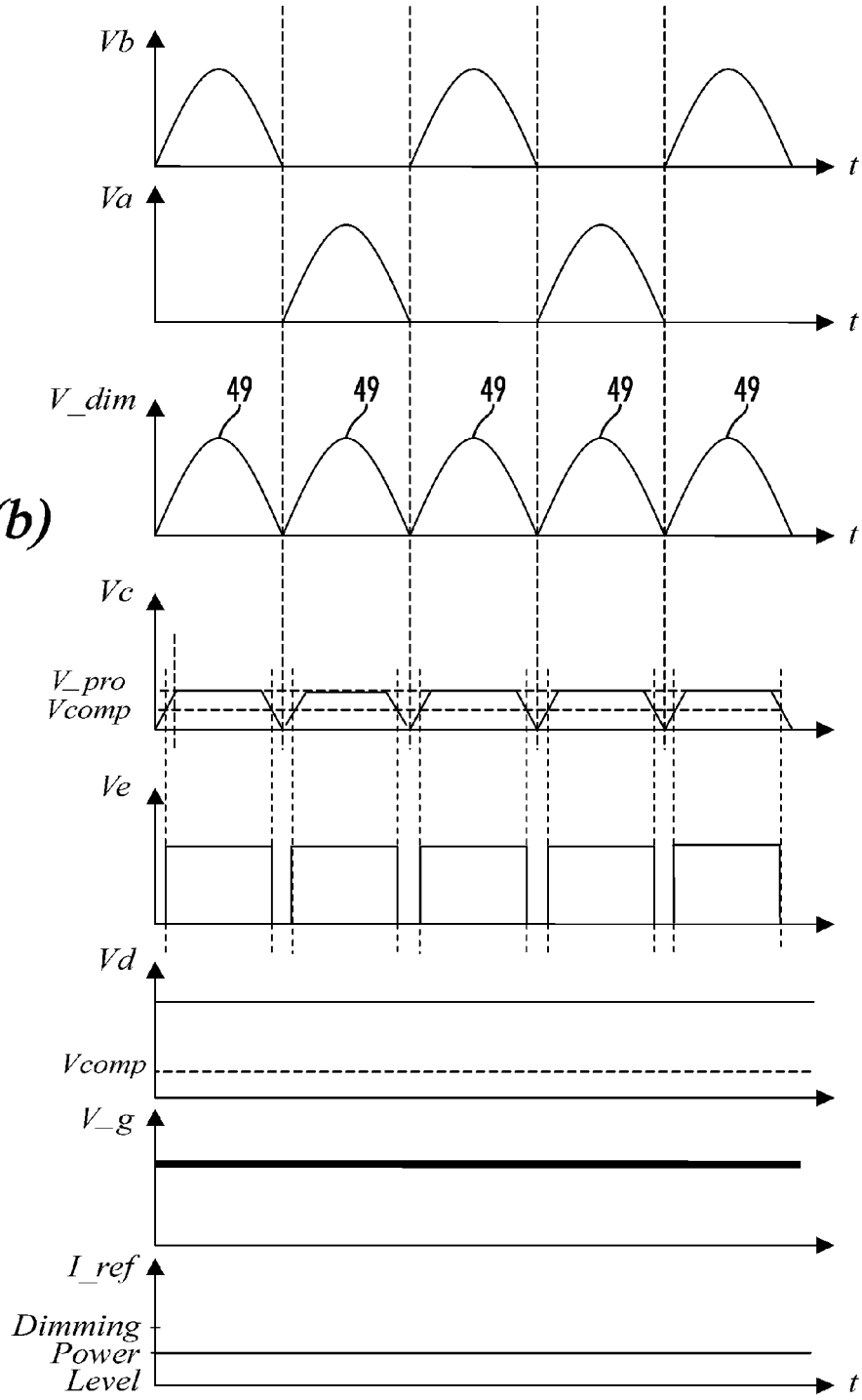
Figure 3:
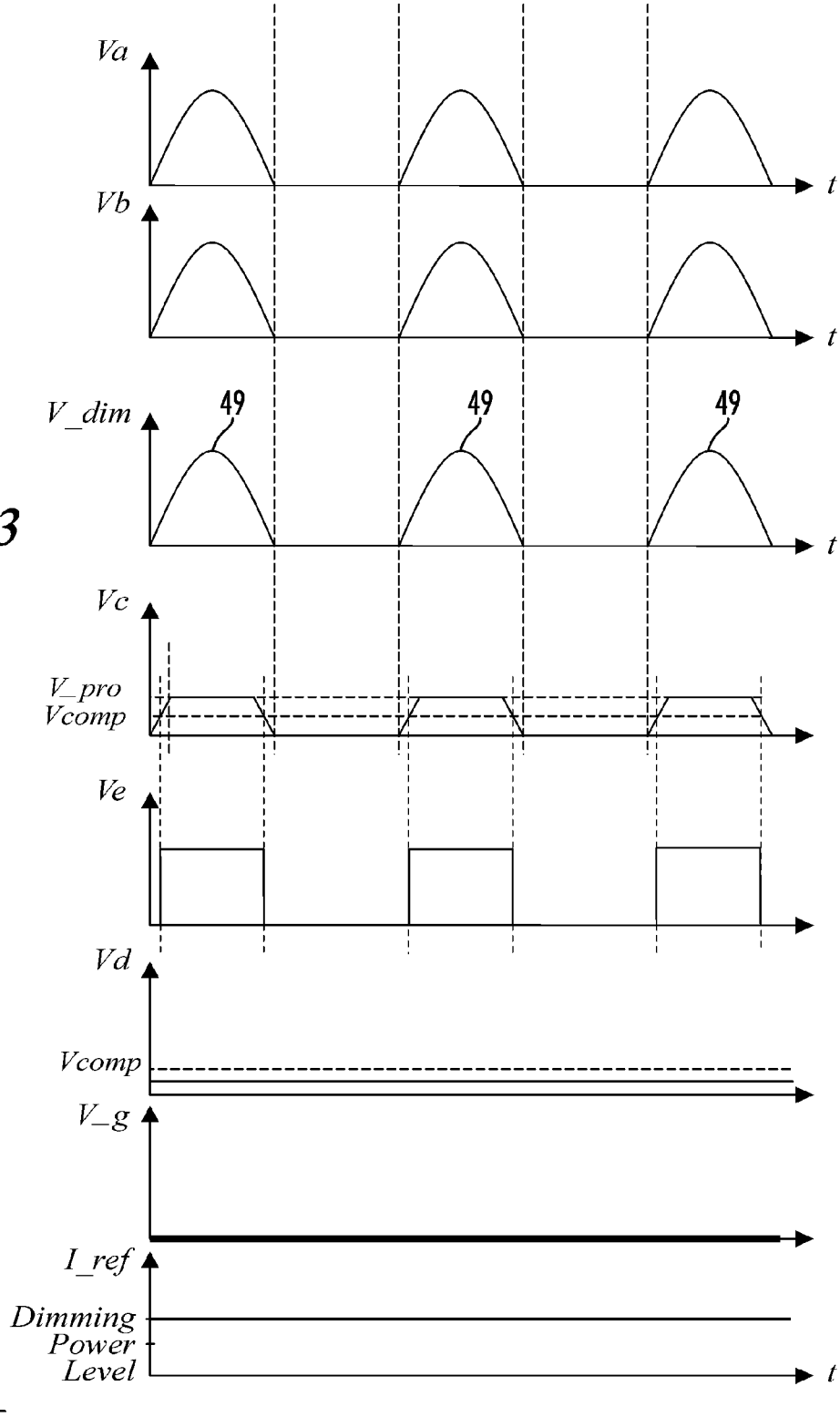
FIG. 3 is a graphic representation of voltage signals produced by the embodiment of the step dimming interface shown in FIG. 1 when both dimming switches are closed.

Referring now to FIGS. 1-3, a dimming interface 10 and the voltage signals produced by the dimming interface 10 are shown. The dimming interface 10 is a step interface meaning that the interface is utilized to operate a load at both a normal power level and at a dimming power level. Preferably, the load is a gas discharge lamp coupled to an electronic ballast that can be controlled with a control signal. The control signal is represented as I_ref in FIG. 1 which represents a DC current for controlling the electronic ballast. In FIGS. 2 and 3, the voltage characteristics of the control signal are also graphically represented as I_ref.

As shown in FIG. 1, power input terminals 12 and 14 connect an AC source 16 to the dimming interface 10. The periodic AC signal from the AC power source 16 is converted into a DC power signal, V_rail, to power a ballast inverter circuit attached to the gas discharge lamp. To convert the periodic AC signal into the DC power signal, V_rail, a rectifier circuit 22 generates a rectified power output signal 24 from the periodic AC signal. The rectified power output signal 24 may then be transmitted through a power factor correction circuit, PFC, and then finally through an integrator, C_rail, to produce a DC power signal, V_rail, that powers the ballast inverter circuit.

The ballast inverter circuit, which will be discussed below, transmits power to the gas discharge lamp at either a dimming power level or at a normal power level. To determine this power level, first and second dimming switches 18, 20 are connected between one of the power input terminals 12, 14 and the rectifier circuit 22. It is the state of these switches 18, 20 that will determine whether the gas discharge lamp operates at the dimming power level or at the normal power level. This is because the operation of these switches 18, 20 determines the characteristics of a dimming interface signal 26 that is output from the rectifier circuit 22 to a dimming control signal generator circuit 28.

In the circuit shown in FIG. 1, the rectifier circuit 22 is responsive to the manipulation of the first and second dimming switches 18, 20 to cause the dimming interface signal 26 to be a half-wave rectified signal when each of the dimming switches 18, 22 are closed and a full wave rectified signal when one of the dimming switches 18, 20 is open and the other dimming switch 20, 18 is closed. In FIGS. 2-3, the dimming interface signal 24 is the combination of signals $V_a$ and $V_b$ and is shown as V_dim.

The embodiment shown in FIG. 1 illustrates one arrangement for the rectifier circuit 22 and the dimming switches 18, 20. In this embodiment, the rectifier circuit 22 has a first rectifier leg 30, a second rectifier leg 32, and a third rectifier leg 34. Through this arrangement, each rectifier leg 32 is a half-bridge rectifier leg that rectifies either the positive or the negative half-cycle of the periodic AC signal from the power input terminals 12, 14. Which leg 30, 32 rectifies a particular half-cycle of the AC periodic signal depends on the switching state of the dimming switches 18, 20. As shown in FIG. 1, the first dimming switch 18 is connected between the negative power input terminal 14 and the second rectifier leg 32. Similarly, the second dimming switch 20 is connected between the same power input terminal 14 and the first rectifier leg 30.

When the first dimming switch 18 is closed and the second dimming switch 20 is open, the first and second rectifier legs 30, 32 rectify the opposite half-cycle of the periodic AC signal. Closing the first dimming switch 18 and opening the second dimming switch 20 causes the first rectifier leg 30 to be connected to the positive power input terminal 12 while the second rectifier leg 32 is connected to the negative input terminal 14. In this case, the positive half-cycle is transmitted through the positive power input terminal 12 and into the first rectifier leg 30. As shown in FIG. 2(*a*), the first leg 30 rectifies the positive half-cycle of the periodic AC signal to form the half-wave rectified signal $V_a$. Conversely, the negative half-cycle of the periodic AC signal is rectified by the second rectifier leg 32. Thus, the negative half-cycle is transmitted through the second rectifier leg 32 to produce the output shown in FIG. 2(*a*) as $V_b$. Accordingly, $V_a$ and $V_b$ are each half-wave rectified signals phase shifted approximately pi/2 radians from one another. The combination of these signals is a full-wave rectified signal that forms the dimming interface signal V_dim.

The first and second rectifier legs 30, 32 also rectify the opposite half-cycles when the first dimming switch 18 is open and the second dimming switch 20 is closed except that the half-cycles rectified by each leg are reversed. In this case, closing the second dimming switch 20 and opening the first dimming switch 18 causes the second rectifier leg 32 to be connected to the positive power input terminal 12 while the first rectifier leg 30 is connected to the negative input terminal 14. Accordingly, the positive half-cycle is transmitted through the positive power input terminal 12 and into the second rectifier leg 32. As shown in FIG. 2(*b*), the second leg 32 rectifies the positive half-cycle of the periodic AC signal to form the half-wave rectified signal $V_b$. Conversely, the negative half-cycle of the periodic AC signal is rectified by the first rectifier leg 30. Thus, the negative half-cycle is transmitted through the first rectifier leg 30 to produce the output shown in FIG. 2(*b*) as $V_a$. In this scenario, $V_a$ and $V_b$ are again each half-wave rectified signals phase shifted approximately pi/2 radians. The combination of these signals is a full-wave rectified signal that results in the dimming interface signal V_dim.

Finally, the first and second rectifier legs 30, 32 both rectify the same half-cycle of the AC periodic signal when both of the dimming switches 18, 20 are closed. As shown in FIG. 1, both rectifier legs 30, 32 are connected to the negative input terminal 14. In this embodiment, both rectifier legs 30, 32 rectify the negative half-cycle of the periodic signal. This is shown as $V_a$, $V_b$ in FIG. 3. The positive half-cycle is rectified by a third leg 34. The dimming interface signal is the combination of $V_a$ and $V_b$ which is the half-wave rectified signal shown as V_dim.

Referring again to FIGS. 1-3, the rectifier circuit 22 has dimming interface output terminals 46 that couple the dimming interface signal V_dim to a dimming control signal generator circuit 28. One of the terminals 46 is connected to the first rectifier leg 30 while another one of the terminals 46 is connected to the second rectifier leg 30. The dimming control signal generator circuit 28 is responsive to the dimming interface signal V_dim to generate a DC control signal, I_ref, for controlling the ballast inverter circuit.

In a preferred embodiment, the dimming control signal generator circuit 28 has a pulse generating circuit 36 and a reference signal production circuit 38. Between the dimming interface output terminals 46 and an input terminal 48 to the pulse generating circuit 36, the pulse generating circuit 36 may have a voltage protection device 50 connected to a ground terminal. To reduce stresses on the circuit components of the pulse generating circuit 36, the voltage protection device 50 assures that the voltage into the input terminal 48 is maintained approximately at or below a protection voltage V_pro. Consequently, the voltage protection device 50 transforms the dimming interface signal V_dim into the semi-trapezoidal waveform shown in FIGS. 2(*a*), 2(*b*), and 3 as $V_c$ and is the voltage at the input terminal 48 of the pulse generating circuit 36.

The pulse generating circuit 36 is operable to generate pulses at a first pulse frequency when one of the dimming switches 18, 20 is open and the other dimming switch 20, 18 is closed. As shown in FIGS. 2(*a*) and 2(*b*), the dimming interface signal, V_dim, in this scenario is a full-wave rectified signal. In a preferred embodiment, the pulse generating circuit 36 has a comparison circuit 37 that receives the voltage $V_c$ at the input terminal 48 and compares the input signal 48 to a comparison value V_comp. The comparison circuit 37 transmits one of the pulses so long as the input signal 48 is approximately at or above the comparison value Vcomp. The resultant pulse train is shown in FIGS. 2(*a*) and 2(*b*) as $V_e$.

The voltage into the input terminal 48 will be above the comparison value, V_comp, when a crest 49 is present in the dimming interface signal. Consequently, as shown in FIG. 3, the pulse generating circuit 36 preferably generates the pulses $V_e$ at a second pulse frequency that is half of the first pulse frequency when both dimming switches 18, 20 are closed.

Referring again to FIGS. 1-3, the pulses $V_e$ are then coupled to a reference signal production circuit 38 that generates a DC control signal, I_ref, having a first control signal value when the pulses $V_e$ are at the first pulse frequency and a second control signal value when the pulses $V_e$ are at the second pulse frequency. Consequently, the reference signal production circuit 38 operates to produce a DC control signal I_ref having a first control signal value when the dimming interface signal V_dim is a full-wave rectified signal, as shown in FIGS. 2(*a*) and 2(*b*), and having a second control signal value when the dimming interface signal is a half-wave rectified signal, as shown in FIG. 3. When the dimming interface signal V_dim is a full-wave rectified signal, the first control signal value of the DC control signal I_ref is low thereby communicating to the electronic ballast that the lamp should be operated at a dimming power level. In contrast, the second control signal value of the DC control signal I_ref is high when the dimming interface signal V_dim is half-wave rectified signal thereby communicating to the electronic ballast that the lamp should be operated at a normal power level. Thus, the manipulation of the dimming switches 18, 20 determines the power level of the lamp.

Referring again to FIGS. 1-3, the reference signal production circuit 38 preferably has a DC source 40 for generating the DC control signal, I_ref, and a reference level determination circuit 42 that receives the pulses $V_e$ to determine the level of the DC control signal, I_ref. A comparison circuit 43 may be connected to a network switch 45 and to a network of resistors (R10, R15, R17). Some of the resistors (R15, R17) have a permanent connection to the DC source 40 while at least one of the other resistors (R10) is connected to the DC source by the closing of the network switch 45.

To determine whether network switch 45 is closed (turned on) or opened (turned off), the reference signal production circuit 38 has an integration component 44 coupled to an output of the pulse generating circuit 36. In a preferred embodiment, the integration component 44 is responsive to the pulses $V_e$ to generate a DC level determination signal $V_d$ having a high DC level determination signal value when the pulses $V_e$ are transmitted at the higher pulse frequency, as shown in FIGS. 2(*a*) and 2(*b*), and a low DC level determination signal value $V_d$ when the pulses $V_e$ are transmitted at the lower pulse frequency, as shown in FIG. 3. Thus, the DC level determination signal $V_d$ has a higher value when one dimming switch 18, 20 is open and the other switch is closed, 20, 18.

The DC level determination signal $V_d$ is transmitted to a comparison circuit 43 connected between the integration component 44 and the network switch 45. The output of the comparison circuit drives the gate voltage $V_g$ of the network switch 45 thereby closing or opening the switch 45. The comparison circuit 43 compares the DC level determination signal $V_d$ with the comparison value V_comp to drive the gate voltage $V_g$ high when the DC level determination signal $V_d$ is high and to drive the gate voltage $V_g$ low when the DC level determination signal $V_d$ is low. Thus, the gate voltage $V_g$ is high and the network switch 45 is closed (on) when one of the dimming switches 18, 20 is closed and the other dimming switch 20, 18 is open. Conversely, the gate voltage $V_g$ is low and the network switch 45 is open (off) when the dimming switches 18, 20 are both closed.

By performing standard node analysis, one can determine the DC control signal, I_ref, transmitted to the electronic ballast. In this embodiment, the DC control signal, I_ref, is a reference current. When both of the dimming switches 18, 20 are closed, the network switch 45 is open and the DC source is not connected to the resistor (R10). Thus, the output of the dimming control signal generator circuit 28 can be expressed as: $I_ref=V_{dc\text{-}source}*R17/(R15+R17)$ which causes the electronic ballast to operate the gas discharge lamp at a normal power level. Conversely, when one of the dimming switches 18, 20 is off and the other dimming switch 20, 18 is open, the output of the dimming control signal generator 28 can be expressed as $I_ref=V_{dc\text{-}source}*R17/[R15+(R17//R10)]$ which is lower than the above mentioned DC control signal value. Consequently, the gas-discharge lamp operates at a dimming power level under these conditions.

Figure 4:
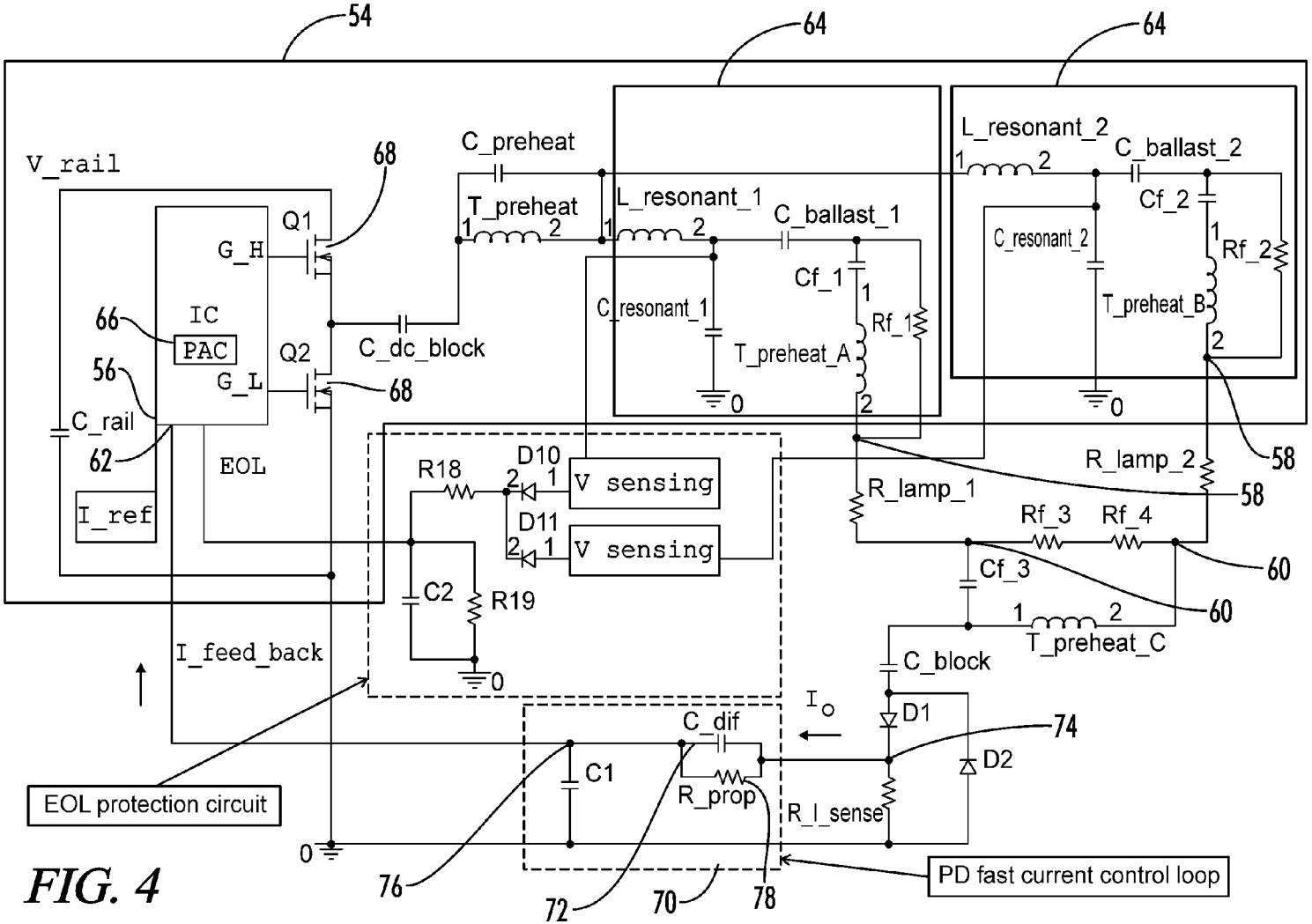
FIG. 4 is an embodiment of a ballast inverter circuit that can be utilized as a part of the step dimming interface of FIG. 1.

Referring now to FIG. 4, a ballast inverter circuit 54 is shown for two high impedance gas discharge lamps, R_lamp_1, R_lamp_2. The ballast inverter circuit 54 converts a DC power signal, V_Rail, into an AC power signal that drive the lamps, R_lamp_1, R_lamp_2. In this embodiment, this is accomplished by switching a pair of inverter switches 68 at a switching frequency and transmitting the signal from the switches 68 through a resonant output circuit 64. In this embodiment, the ballast inverter circuit 54 has a resonant output circuit 64 for each lamp R_lamp_1, R_lamp_2. The AC power signal is transmitted through the inverter outputs 58 to the lamps.

The DC control signal, I_ref, is received from the dimming control signal generator circuit 28 through an inverter input 56 and is utilized to control the power transmitted from the ballast inverter circuit 54 to the lamps, R_lamp_1, R_lamp_2. When the DC control signal, I_ref is high, the inverter circuit 54 varies the switching frequency of the inverter switches 68 so that the lamps R_lamp_1, R_lamp_2 operate at the normal power level. In contrast, the inverter circuit 54 varies the switching frequency of the inverter switches 68 so that the lamps R_lamp_1, R_lamp_2 operate at the dimming power level when the DC control signal, I_ref, is low.

To assure that the lamps R_lamp_1, R_lamp_2 are operated at the appropriate power levels, the ballast inverter circuit 54 has a feedback terminal coupled to the lamp terminals 60 for receiving a feedback signal associated with an actual power output to the gas discharge lamp R_lamp_1, R_lamp_2. In this embodiment, the feedback signal is a current feedback signal, I_feed_back.

To assure that the power level of the lamp remains at the desired level, a power adjustment circuit 66 in the inverter circuit 54 utilizes the feedback signal, I_feed_back, and the DC control signal, I_ref, to measure a lamp power variance between a desired power output to the lamps R_lamp_1, R_lamp_2 and the actual power output to the lamps R_lamp_1, R_lamp_2. Consequently, when the DC control signal, I_ref, is at the high value the ballast inverter circuit should be operating at the normal power level. The power adjustment circuit then compares a signal associated with the feedback signal, I_feed_back, and a signal associated with the DC control signal, I_ref, to determine if a power variance exists. If a power variance exists because the lamps R_lamp_1, R_lamp_2 are not operating at a normal power level, the power adjustment circuit 66 is operable to adjust the switching frequency of the inverter switches 68 so that the power variance is reduced or eliminated. The same process occurs when DC control signal, I_ref, is at a low level except that the power adjustment circuit adjusts the switching frequency to reduce a power variance between the dimming power level and the actual power level of the lamps R_lamp_1, R_lamp_2.

The circuit may utilize a fast feedback current loop, as shown in the feedback block 70, to return the feedback current, I_feed_back to the ballast inverter 54. The feedback block 70 is connected between the feedback terminal 62 and the lamp terminals 60. The lamp terminals 60 couple a lamp measurement output signal, $I_o$, which is received at a feedback block input terminal 74. Unfortunately, the presence of the capacitor, C1, in a fast feedback current loop causes a lag in the phase relationship between the lamp measurement output signal, $I_o$, which is in phase with the current in the lamps R_lamp_1, R_lamp_2 and the feedback signal, I_feed_back. To correct this problem, a phase shifting component, 72, such as a capacitor is connected between the feedback signal input terminal 74 and the feedback signal output terminal 76.

As can be seen from the descriptions of the embodiments described above, the circuit of the present invention is inexpensive to manufacture. Instead of utilizing transformers and transistors to transfer and manipulate signals and circuit components, the dimming interface topology described above can utilize lower cost circuit components such as resistors and low speed glass diodes.

Thus, although there have been described particular embodiments of the present invention of a new and useful Low Cost Step Dimming Interface for an Electronic Ballast, it is not intended that such references be construed as limitations upon the scope of this invention except as set forth in the following claims.

What is claimed is:

1. A dimming interface for use with an electronic ballast powering a gas discharge lamp, the electronic ballast including a ballast inverter circuit, the dimming interface comprising:

first and second power input terminals for connecting an AC source;

a first dimming switch coupled to the first power input terminal;

a second dimming switch coupled to the second power input terminal;

a rectifier circuit coupled to the first and second dimming switches, the rectifier circuit operative to generate a rectified output power signal for providing power to a ballast inverter circuit and to output a dimming interface signal for controlling the ballast inverter circuit;

the rectifier circuit is responsive to manipulation of the first and second dimming switches to cause the dimming interface signal to be a half-wave rectified signal when each of the dimming switches is closed, and a full-wave rectified signal when one of the dimming switches is open and the other dimming switch is closed;

a dimming control signal generator circuit operably coupled to the rectifier circuit to receive the dimming interface signal; and wherein the dimming control signal generator circuit is responsive to the dimming interface signal to generate a DC control signal, the DC control signal having a first value when the dimming interface signal is a half-wave rectified signal and having a second value when the dimming interface signal is a full-wave rectified signal.

2. The dimming interface of claim 1, further comprising:

a ballast inverter circuit having an inverter input and an inverter output, the inverter input operably coupled to the dimming control signal generator circuit to receive the DC control signal; and the ballast inverter circuit is operative to generate an AC power signal at the inverter output that varies in response to changes in the DC control signal.

3. The dimming interface of claim 2, the ballast inverter circuit further comprising:

one or more lamp terminals operably associated with the inverter output;

a feedback terminal coupled to the lamp terminals for receiving a feedback signal associated with an actual power output to a gas discharge lamp coupled to the inverter output; and a power adjustment circuit that utilizes the feedback signal and the DC control signal to measure a lamp power variance between a first desired power output to the lamp and the actual power output to the lamp when the DC control signal is the first value and between a second desired power output to the lamp and the actual power output to the lamp when the DC control signal is the second value.

4. The dimming interface of claim 3 wherein:

the ballast inverter circuit comprises a resonant output circuit; and the power adjustment circuit is operable to cause the ballast inverter circuit to vary a frequency of the AC power signal so that the lamp power variance is reduced.

5. The dimming interface of claim 3, wherein:

the ballast inverter circuit further comprises at least two inverter switches for generating the AC power signal at a switching frequency and a resonant output circuit coupled to the inverter switches; and the power adjustment circuit is operable to vary the switching frequency such that the power variance is reduced.

6. The dimming interface of claim 3, further comprising a feedback block that is connected between the feedback terminal and the lamp terminals for receiving a lamp measurement output signal from the lamp terminals, the feedback block being responsive to the lamp measurement output signal to produce the feedback signal and having a phase shifting component to reduce a phase lag between the between the load measurement output signal and the feedback signal.

7. The dimming interface of claim 6, wherein the feedback block further comprises:

a feedback signal input terminal for receiving the load measurement output signal and a feedback signal output terminal for transmitting the feedback signal; and the phase shifting component being connected between the feedback signal input terminal and the feedback signal output terminal.

8. The dimming interface of claim 6, wherein the feedback block further comprises:

a feedback signal input terminal for receiving the load measurement output signal and a feedback signal output terminal for transmitting the feedback signal;

the feedback block having a resistor connected between the feedback signal input terminal and the feedback signal output terminal; and the phase shifting component being connected in parallel to the resistor.

9. The dimming interface of claim 6, wherein the phase shifting component comprises a capacitor.

10. The dimming interface of claim 1, wherein the rectifier circuit further comprises first and second rectifier legs and the dimming control signal generator circuit is operably coupled to the first and second rectifier legs to receive the dimming interface signal.

11. The dimming interface of claim 10, wherein:

the rectifier circuit is operable to rectify a periodic AC signal having a positive half-cycle and a negative half-cycle;

the first and second dimming switches are arranged with respect to the rectifier circuit so that the first and second rectifier legs are each operable to rectify the same one of the half-cycles of the periodic AC signal when the first and second switches are closed whereby the dimming interface signal comprises the half-wave rectified signal; and the first and second switches being arranged with respect to the rectifier circuit so that the first rectifier leg rectifies one of the half-cycles of the periodic AC signal and the second rectifier leg rectifies the other half-cycle of the periodic signal when one of the switches is open and the other switch is closed whereby the dimming interface signal comprises the full-wave rectified signal.

12. The dimming interface of claim 11, further comprising:

the rectifier circuit including a third rectifier leg; and the first and second dimming switches being arranged with respect to the third rectifier leg so that the third rectifier leg rectifies the other half-cycle of the periodic AC signal when both of the dimming switches are closed.

13. The dimming interface of claim 10, wherein:

the first dimming switch is connected between one of the power input terminals and the first rectifier leg; and the second dimming switch is connected between the same one of the power input terminal and the second rectifier leg.

14. A dimming interface for use with an electronic ballast powering a gas discharge lamp, the electronic ballast including an inverter circuit, the dimming interface comprising:

first and second power input terminals for connecting an AC source;

a rectifier circuit for rectifying a periodic AC signal from the AC source;

a first dimming switch connected between one of the power input terminals and the rectifier circuit;

a second dimming switch connected between one of the power input terminals and the rectifier circuit;

a dimming signal generator circuit operably coupled to the rectifier circuit, the dimming signal generating including a pulse generating circuit operable to generate pulses at a first pulse frequency when one of the switches is open and the other switch is closed and to generate the pulses at a second pulse frequency when both switches are closed; and a reference signal production circuit operably coupled to the pulse generating circuit, the reference signal production circuit receiving the pulses and generating a DC reference signal having a first reference signal value when the pulses are transmitted at the first pulse frequency and a second reference signal value when the pulses are transmitted at the second pulse frequency.

15. The dimming interface of claim 14, wherein the reference signal production circuit further comprises:

a DC source for generating the DC reference signal;

a signal production circuit having a network of two or more resistors and a network switch, the signal production circuit being responsive to open the network switch when the pulses are transmitted at one of the frequencies and closing the network switch when the pulses are transmitted at the other frequency; and the network switch being arranged with respect to at least one of the resistors such that the network switch operably couples the DC source to the at least one of the resistors when the network switch is closed and uncouples the DC source to the at least one of resistors when the network switch is open.

16. The dimming interface of claim 15, wherein the signal production circuit further comprises:

an integration component coupled to an output of the pulse generating circuit wherein the integration component is responsive to the pulses to generate a DC level determination signal having a first DC level determination signal value when the pulses are transmitted at the first pulse frequency and a second DC level determination signal value when the pulses are transmitted at the second pulse frequency; and a comparison circuit connected between the integration component and the network switch, the comparison circuit comparing the DC level determination signal with a comparison value to open the network switch when the DC level determination signal is at one of the DC level determination signal values and to close the network switch when the DC level determination signal is at the other DC level determination signal value.

17. The dimming interface of claim 14, further comprising:

the rectifier circuit having one or more dimming interface output terminals for transmitting a dimming interface signal, the rectified dimming output signal being a half-wave rectified signal when both of the dimming switches are closed and being a full-wave rectified signal when one of the dimming switches is open and the other dimming switch is closed; and the pulse generating circuit including a comparison circuit, the comparison circuit having an input terminal coupled to the dimming interface output terminals for receiving an input signal associated with the dimming interface signal and being operable to compare the input signal and a comparison value wherein the pulse generating circuit transmits one of the pulses so long as the input signal is approximately at or above the comparison value.

18. The dimming interface of claim 17, further comprising a voltage protection device having a breakdown voltage, the voltage protection device being connected between the rectifier circuit and a ground terminal so that the input signal is maintained approximately at or below the breakdown voltage.

19. The dimming interface of claim 18, wherein the voltage protection device is a reverse biased zener diode.

20. A method of controlling a dimming level of a lamp, comprising:

rectifying an AC signal to produce a rectified output signal, the rectified output signal being a half-wave rectified signal when the lamp is to be dimmed and being a full-wave rectified signal when the lamp is to be at full brightness;

converting the rectified signal into a DC reference signal, the DC reference signal having a first level when the rectified output signal is a half-wave rectified signal and being at a second level when the rectified output signal is a full-wave rectified signal;

transmitting the DC reference signal to an inverter operably associated with the lamp; and controlling one or more switches on the inverter according to the level of the DC reference signal.

* * * * *